United States Patent [19]

Fringeli

[11] 4,364,845

[45] Dec. 21, 1982

[54] CONCENTRATED AQUEOUS SOLUTIONS OF SULFO GROUP-CONTAINING FLUORESCENT BRIGHTENERS WHICH ARE STABLE ON STORAGE

[75] Inventor: Werner Fringeli, Laufen, Switzerland

[73] Assignee: Ciba-Geigy Corporation, Ardsley, N.Y.

[21] Appl. No.: 55,417

[22] Filed: Jul. 6, 1979

[30] Foreign Application Priority Data

Jul. 17, 1978 [CH] Switzerland ..... 7706/78

[51] Int. Cl.[3] ..... C09K 11/06

[52] U.S. Cl. ..... 252/301.22

[58] Field of Search ..... 252/301.22

[56] References Cited

FOREIGN PATENT DOCUMENTS 1206296 12/1965 Fed. Rep. of Germany .
1594854 3/1973 Fed. Rep. of Germany .
2458271 7/1975 Fed. Rep. of Germany .
2422386 12/1975 Fed. Rep. of Germany .
2607428 9/1976 Fed. Rep. of Germany .
2458580 7/1977 Fed. Rep. of Germany .
2709636 9/1977 Fed. Rep. of Germany .
986338 3/1965 United Kingdom .
1000825 8/1965 United Kingdom .
1060063 2/1967 United Kingdom .
1202798 8/1970 United Kingdom .
1507088 4/1978 United Kingdom .
1533353 11/1978 United Kingdom .

*Primary Examiner*—F. Edmundson
*Attorney, Agent, or Firm*—Edward McC. Roberts

[57] ABSTRACT

Concentrated aqueous solutions of sulfo group-containing fluorescent brighteners, which are stable on storage, containing a stilbene fluorescent brightener substituted by sulfo groups and a lactam of the formula

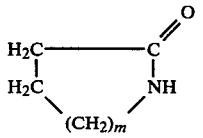

in which m is 0 or an integer between 1 and 9, and their use for the fluorescent brightening of high molecular weight organic material.

9 Claims, No Drawings

CONCENTRATED AQUEOUS SOLUTIONS OF SULFO GROUP-CONTAINING FLUORESCENT BRIGHTENERS WHICH ARE STABLE ON STORAGE

The invention relates to novel aqueous solutions of water-soluble, sulfo group-containing fluorescent brighteners of the stilbene series, which have a high brightener content, excellent storage stability and very good miscibility with water, their preparation and their use for the fluorescent brightening of high-molecular weight organic material.

If fluorescent brighteners are marketed in the pure form as finely crystalline or finely ground powders, several well-known disadvantages arise: the dust formed by these powders proves troublesome to the personnel working therewith and gives rise to pollution of the environment. Furthermore, in humid air lumps form easily and these further lower the rate at which the brighteners dissolve in water, which rate is in most cases already low. In order to reduce the formation of dust and to increase the rate of dissolution, improved solid commercial forms have already been developed, for example by compression and granulation and the addition of diverse assistants. However, the disadvantages described cannot be completely eliminated by this means.

Liquid commercial forms of fluorescent brighteners, on the other hand, have the advantage that they are free from dust and can be metered more accurately and result in a substantial increase in the rate of dissolution in water. However, purely aqueous concentrated fluorescent brightener solutions can be prepared only in the case of exceptionally readily soluble fluorescent brighteners (cf., for example, British Pat. Nos. 986,338 and 1,000,825). The majority of the fluorescent brighteners containing sulfo groups have too low a solubility in water to give sufficiently concentrated solutions. It is therefore necessary to increase the solubility of these fluorescent brighteners. Furthermore, the problem of the storage stability arises when fluorescent brightener solutions are used, since the fluorescent brighteners crystallise out easily.

Proposals for the solution of the problems just described have therefore been disclosed in the literature. Thus, the use of various organic solvents to increase the solubility has been proposed. Solutions which contain relatively large amounts of mineral acids have also been marketed. Aqueous dipsersions of water-soluble fluorescent brighteners, which contain a stabiliser, have also been proposed. Furthermore, solutions are known which contain, as additives, aminoplast precondensates, urea, lower carboxylic acids, higher molecular weight ethers and others. In this context see German Pat. No. 1,206,296, German Auslegeschrift No. 1,594,854 and German Offenlegungsschriften Nos. 2,607,428, 2,458,271 and 2,709,636. However, the solutions proposed will still have various disadvantages, such as the disadvantage of the presence of large amounts of solvent, which is not consumed during the application and results in a load on the effluent and on the waste air, the presence of acids and the difficulty in handling associated therewith, the fact that the fluorescent brightener content of some of these solutions is too low or the limited storage stability and stability to cold of these solutions.

Formulations of specific dyes, which contain caprolactam (British Pat. No. 1,060,063 and German Auslegeschrift No. 2,458,580) or ϵ-lactam/polyalcohol associates (German Offenlegungsschrift No. 2,422,386), are also known from the literature.

The object of the present invention is to provide aqueous solutions of sulfonic acid group-containing stilbene fluorescent brighteners, which have a high storage stability and are suitable as liquid commercial forms, and which permit as high as possible a concentration of fluorescent brightener and do not have the disadvantages, described above, of known liquid formulations. It has now been found, surprisingly, that aqueous solutions of such brighteners, which contain a lactam as the additive, possess the requisite characteristics to a high degree. Further advantages of these solutions are their good stability to cold and their low viscosity, even at high fluorescent brightener concentrations, compared with the known liquid formulations.

The characterising feature of the aqueous solutions according to the invention is that they contain a stilbene fluorescent brightener substituted by sulfo groups and a lactam of the formula

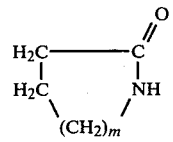

(1)

in which m is 0 or an integer between 1 and 9.

If desired, the solutions according to the invention can additionally contain a water-miscible organic solvent as a solubilising agent. Suitable solvents of this type are, inter alia, monohydric alcohols, polyhydric alcohols, ether-alcohols, low-molecular polyethylene glycols or carboxylic acid amines. Examples of such solvents are: propanol, isopropanol, ethylene glycol, propylene glycol, glycerol, di- or tri-ethylene glycol, dipropylene glycol, ethylene glycol monomethyl ether or ethylene glycol monoethyl ether, diethylene glycol monoethyl ether, formamide, dimethylformamide, dimethylacetamide, ethanolamine, diethanolamine, triethanolamine, N-methylpyrrolidone, polyethylene glycols or polyvinylpyrrolidones. Preferred solvents are ethylene glycol, polyethylene glycols and polyvinylpyrrolidones.

As mentioned above, one object of the invention is to prepare solutions which have fluorescent brightener concentrations which are as high as possible. Therefore, the solutions according to the invention preferably contain 10 to 30% by weight of fluorescent brightener, 10 to 80% by weight of lactam and 10 to 80% by weight of water or, if they additionally contain a water-miscible organic solvent, 10 to 30% by weight of fluorescent brightener, 10 to 80% by weight of lactam, 5 to 75% by weight of organic solvent and 5 to 75% by weight of water.

The lactams of the formula (1) which are used are in particular those in which m=1, 2 or 3. ϵ-Caprolactam (m=3) is preferred.

Furthermore, the solutions according to the invention can also contain various assistants, for example inorganic or organic acids, such as hydrochloric acid, acetic acid and formic acid, non-ionic surfactants, polyethylene glycols and/or urea. Depending on the fluorescent brightener used, such assistants can further improve the characteristics of the solutions, for example can increase the maximum fluorescent brightener concentration or can further reduce the viscosity. Furthermore, the solutions can also contain inorganic salts, for example NaCl or $Na_2SO_4$. As a rule, these salts are introduced together with the fluorescent brightener when preparing the solutions, since the fluorescent brightener, especially if it is a bis-triazinylaminostilbene fluorescent brightener, is frequently not employed in the purified form but in the form of the press cake which is obtained from the industrial process of preparation and which contains a certain amount of salt.

All fluorescent brighteners which contain one or two stilbene groups, for example a distyrylbiphenyl group, and are substituted by sulfo groups can be formulated as solutions according to the invention. "Sulfo groups" are to be understood as meaning groups of the formula $-SO_3X$, in which X is hydrogen or an alkali metal, ammonium or amine ion, preferably hydrogen, sodium, potassium or ammonium. An amine ion is to be understood as meaning a cation of the formula $HN^{\oplus}R_5R_6$, in which $R_5$ is hydrogen or a substituted or unsubstituted alkyl radical and $R_6$ is a substituted or unsubstituted alkyl radical, or the two radicals together form the remaining part of a heterocyclic ring, preferred substituted alkyl radicals being hydroxyalkyl, cyanoalkyl and halogenoalkyl radicals having 2 to 4 carbon atoms in the alkyl moiety or the benzyl radical.

Fluorescent brighteners which preferentially can be formulated with the aid of the solutions according to the invention include:

Fluorescent brighteners of the formula (2)

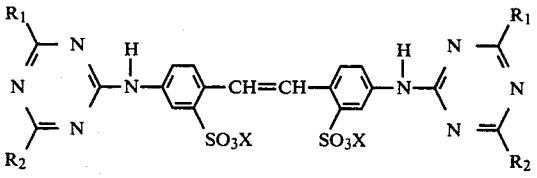

in which X is hydrogen or an alkali metal, ammonium or amine ion and $R_1$ and $R_2$ independently of one another are each $NH_2$, $NH-CH_3$, $NH-C_2H_5$, $N(CH_3)_2$, $N(C_2H_5)_2$, $NH-CH_2-CH_2-OH$, $NH-CH_2-CH_2-CH_2-OH$, $N(CH_2-CH_2-OH)_2$, $N(CH_2-CH_2-CH_2-OH)_2$, $N(CH_3)(CH_2-CH_2-OH)$, $NH-CH_2-CH_2-O-CH_2-CH_2-OH$, $NH-CH_2-CH_2-SO_3X$, OH, $OCH_3$, $OCH(CH_3)_2$,

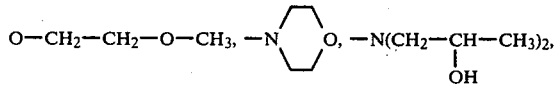

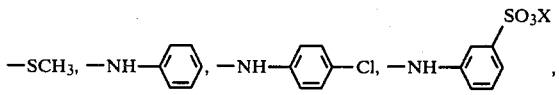

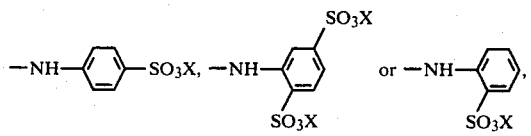

of the formula

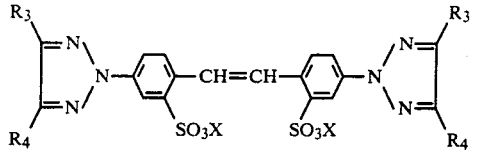

(3)

in which X is hydrogen or an alkali metal, ammonium or amine ion and $R_3$ and $R_4$ independently of one another are hydrogen,

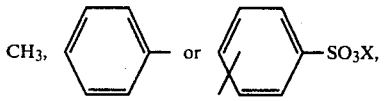

or $R_3$ and $R_4$ together form the remaining part of a benzene ring, and of the formula (4)

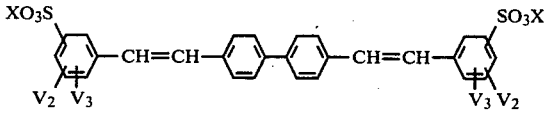

in which $V_2$ is hydrogen, alkyl having 1 to 4 carbon atoms, alkoxy having 1 to 4 carbon atoms, halogen or the sulfo group or also the alkali metal, ammonium or amine salts thereof, $V_3$ is hydrogen or alkyl having 1 to 4 carbon atoms and X is hydrogen or an alkali metal, ammonium or amine ion, and especially the fluorescent brighteners of the formula (5)

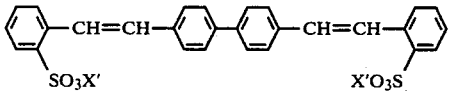

in which X' is hydrogen or sodium.

The solutions according to the invention are generally obtained by dissolving the corresponding stilbene fluorescent brightener in water or a mixture of water and a water-miscible solvent, with the addition of a lactam of the formula (1), if necessary with warming and stirring.

Depending on the nature of the fluorescent brightener which is dissolved, the solutions according to the invention can be used for the fluorescent brightening of very diverse high molecular weight organic materials. This use is also a subject of the invention. The substrates which are to undergo fluorescent brightening can be, for example, synthetic, regenerated man-made or natural textile fibres, paper or detergents.

Paper can be whitened direct by adding the solutions according to the invention to the paper pulp, if desired after adding assistants customary in papermaking.

The whitening of paper, but also of textiles, can also be effected in the course of surface finishing. For this purpose, the solutions according to the invention are added to the coating agents necessary for surface finishing. Coating agents are understood as meaning preparations for the coating of paper and other textile and non-textile natural or synthetic organic materials, for example paper coating compositions. Fluorescent brightening can be effected by incorporating the solutions according to the invention into the coating agents which are to be applied and applying these agents to the substrates in a manner known per se. The coating agent is to be understood as meaning in particular a paper coating composition which consists of an aqueous preparation and contains a polymeric binder, an inorganic pigment and, if desired, further additives, for example waxes, dispersing agents, wetting agents or other surface-active agents, agents which control the viscosity, anti-foams, lubricants, plasticisers and preservatives.

Suitable polymeric binders are the customary polymeric adhesive/binder systems used in the paper industry. Thus, in particular, it is possible to use any of the known, modified or converted types of starch, for example oxidised, hydrolysed or hydroxyethylated starches. In addition to the various sorts and types of starch, other natural or synthetic polymeric binder systems can also be used, on their own or, especially in the case of synthetic polymeric binders, in combination with one another.

Suitable binders as casein, soya protein, polyvinyl alcohol and many different types of latex, for example polyvinyl acetate, styrene/butadiene copolymers and very diverse acrylic polymers, such as polyacrylic acid, polyethyl acrylate or polymethyl methacrylate.

Since the solutions according to the invention can be diluted very readily and rapidly with water, they are also outstandingly suitable for whitening textile substrates by the conventional processes for the application of fluorescent brighteners (for example the exhaust method and the pad-bake method).

For this purpose, the concentrated solutions are diluted with water so that the solutions for application, which are formed therefrom and to which customary assistants can also be added, contain the desired concentrations of fluorescent brightener.

Substrates which can be whitened are textile fibres made of synthetic materials, for example polyamide, made of regenerated man-made materials, for example regenerated cellulose, and made of natural materials, for example wool or cotton, and also of mixed fibres, for example polyester/cotton, and the natural fibres can also be finished in the manner customary in the textile industry.

The textile materials which are to undergo fluorescent brightening can be in the most diverse states of processing (raw materials, semi-finished goods or finished goods). Fibrous materials, for example, can be in the form of staple fibres, flocks, hank goods, textile filaments, yarns, twisted yarns, bonded fibre webs, felts, waddings, flocking structures, textile composite materials or knitted fabrics, but preferably in the form of woven textile fabrics.

The treatment of the latter is effected with the dilute solutions according to the invention, if desired after adding dispersing agents, stabilisers, wetting agents and further assistants.

Depending on the fluorescent brightener which is dissolved, it can prove advantageous preferably to work in a neutral bath, in an alkaline bath or in an acid bath. The treatment is usually carried out at temperatures of about 20° to 140° C., for example at the boiling point of the bath or near it (about 90° C.).

The following assistants can also be added to the bath: dyes (shading), pigments (coloured pigments or especially, for example, white pigments), so-called "carriers", wetting agents, plasticisers, swelling agents, antioxidants, light stabilisers, heat stabilisers, chemical bleaching agents (chlorite bleach or bleaching bath additives), crosslinking agents, finishing agents (for example starch or synthetic finishes) and agents which are used in very diverse textile finishing processes, especially agents for providing resin finishes (for example creaseproof finishes, such as "wash-and-wear", "permanent-press" or "non-iron"), and also flameproof finishes, soft-handle finishes, anti-soiling finishes or antistatic finishes, or antimicrobial finishes.

In certain cases, an after-treatment is carried out after the treatment with the fluorescent brightener solution. This after-treatment can be, for example, a chemical treatment (for example acid treatment), a heat treatment or a combined chemical/heat treatment. Thus, for example, the appropriate procedure to follow when subjecting a number of fibre substrates to fluorescent brightening is to impregnate these fibres with the aqueous solutions described at temperatures below 75° C., for example at room temperature, and to subject them to a dry heat treatment at temperatures above 100° C., it being generally advisable additionally to dry the fibrous material beforehand at a moderately elevated temperature, for example at not less than 60° C. to about 130° C. The heat treatment in the dry state is then advantageously carried out at temperatures between 120° and 225° C., for example by heating in a drying chamber, by ironing within the specified temperature range or by treatment with dry, superheated steam. The drying and dry heat treatment can also be carried out in immediate succession or combined in a single operation.

Dilution of the concentrated fluorescent brightener solutions according to the invention to give the corresponding application baths is carried out so that, on impregnating the corresponding substrate, the fluorescent brightener is taken up by this in an amount of at least 0.0001 percent by weight but at most 2 percent by weight and preferably of between 0.0005 and 0.5 percent by weight. The concentration required depends on the liquor ratio to be employed and on the nature of the substrate and of the fluorescent brightener which is dissolved, and can be calculated in a simple manner from these values.

The solutions according to the invention can also be added to wash baths or detergents. In the case of wash baths, the solution is simply metered in in an amount which contains the desired amount of fluorescent brightener. The solutions according to the invention can be added to detergents in any stage of the manufacturing process, for example to the so-called "slurry" before the washing powder is atomised, or during the preparation of liquid detergent combinations.

Suitable detergents are the known mixtures of active detergents, for example soap in the form of chips and powders, synthetics, soluble salts of sulfonic acid hemiesters of higher fatty alcohols, arylsulfonic acids with higher and/or multiple alkyl substituents, sulfocarboxylic acid esters of medium to higher alcohols, fatty acid acylaminoalkyl- or acylaminoaryl-glycerol sulfonates, phosphoric acid esters of fatty alcohols, and the like. Suitable builders which can be used are, for example, alkali metal polyphosphates and polymetaphosphates, alkali metal pyrophosphates, alkali metal salts of carboxymethylcellulose and other soil redeposition inhibitors, and also alkali metal silicates, alkali metal carbonates, alkali metal borates, alkali metal perborates, nitrilotriacetic acid and ethylenediaminetetraacetic acid, and foam stabilisers, such as alkanolamides of higher fatty acids. The detergents can also contain, for example: antistatic agents, fat-restorative skin protectives, such as lanolin, enzymes, antimicrobial agents, perfumes and dyes.

The amount of solution according to the invention which is added to the detergent is measured so that the latter then contains about 0.001 to 0.5 percent by weight of fluorescent brightener, based on the solids content of the detergent.

The following examples, in which parts and percentages are always by weight unless stated otherwise, describe several solutions according to the invention and their use. However, analogous solutions can be prepared equally successfully with other sulfo group-containing stilbene fluorescent brighteners which are not mentioned in the examples.

EXAMPLE 1

35.0 g of the fluorescent brightener of the formula

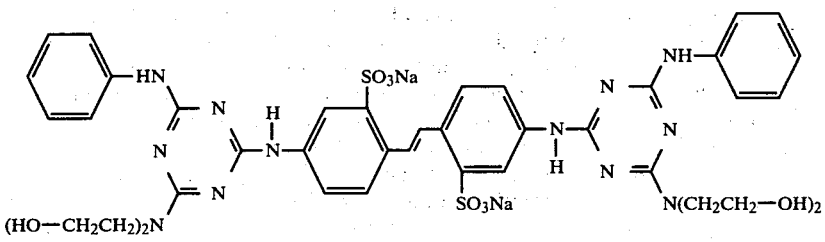

(10)

(containing 4.9% of NaCl and 7.3% of water) are introduced at 50° to 60° C. into a mixture of 27 g of ε-caprolactam, 5 g of polyvinylpyrrolidone K 25 and 29 g of water. The mixture is stirred for 15 minutes at 50° to 60° C. and the fluorescent brightener goes into solution. This fluorescent brightener solution is stable to cold and meets the requirement with regard to dilutability with water, which is customary in paper applications.

EXAMPLE 1a 50 g of bleached cellulose (10% suspension) are stirred in a metal beaker with 99 ml of water and 1 ml of 10% aluminium sulfate solution. After 2 minutes, 7.5 ml of a 10% filler suspension (kaolin) are added and after 10 minutes 0.026 g of the solution obtained according to Example 1 is added. At intervals of a further 2 minutes, in each case, 2 ml of 5% resin size solution and 1.5 ml of 10% aluminium sulfate solution are added. The mixture is then made up to 500 ml with water and the suspension is transferred to a mixing beaker, made up to 1,000 ml with water and mixed for 2 seconds. Processing of the pulp to paper sheets, including pressing and drying, is effected in a known manner.

The paper thus obtained has a powerful white effect with good fastness to light.

EXAMPLE 1b 5.1 g of the solution obtained according to Example 1 are dissolved in 50 ml of hot, distilled water at 90° C. On the other hand, 80 g of a degraded starch are dissolved in 1,000 ml of hot water at 90° C., to give a colloidal solution. The fluorescent brightener solution is then incorporated in the starch solution. The resulting solution can have a pH value of 5.5 to 7.

The surface of sized printing paper is coated with this size liquor in a size press and the coated paper is dried at about 90° to 120° C. in the dry section of the paper machine.

A paper of very high whiteness is thus obtained.

Sized card can be used in place of sized paper with equal success.

EXAMPLE 2

20 g of the fluorescent brightener of the formula

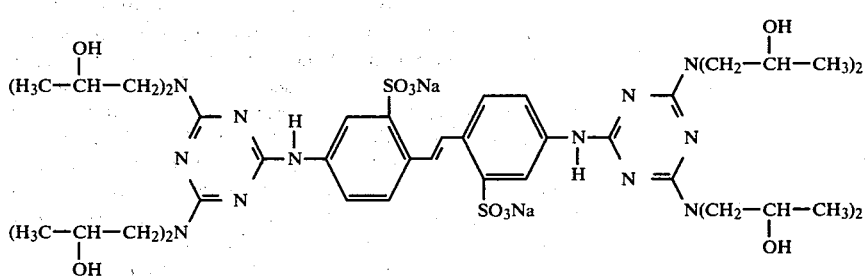

(11)

(containing 10% of water) are introduced at 50° to 60° C. into a mixture of 18 g of polyethylene glycol 5000/6000, 12 g of ε-caprolactam and 50 g of water. The mixture is stirred for 30 minutes at 70° to 80° C. and the fluorescent brightener goes into solution. The resulting solution is stable on storage and stable to cold and its miscibility with water is excellent.

EXAMPLE 2a

A pigment coating liquor of the following composition is prepared: 150 ml of a 50% aqueous synthetic resin dispersion based on a crosslinkable methyl acrylate/styrene copolymer, 100 ml of water containing 2 g of sodium polyphosphate, 600 ml of water containing 20 g of the solution obtained according to Example 2, 50 ml of water containing 2 g of nonylphenol pentadecaglycol ether and 500 g of aluminium magnesium silicate.

A sized and weighted sulfite cellulose raw paper is coated with this treatment liquor and then dried. A paper of very high whiteness is thus obtained.

EXAMPLE 3

30 g of the fluorescent brightener of the formula

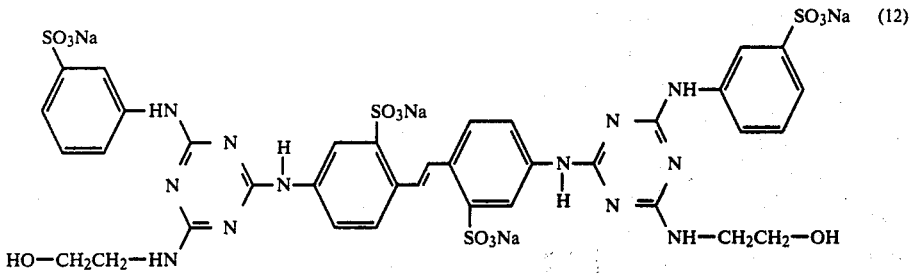

(12)

(containing 14% of NaCl and 7.5% of water) are introduced at 50° to 60° C. into a mixture of 40 g of ε-caprolactam and 30 g of water. The mixture is stirred for 30 minutes at 70° to 80° C. and the fluorescent brightener goes into solution. The resulting solution is stable on storage and stable to cold and its miscibility with water is excellent.

EXAMPLE 4

15 g of the fluorescent brightener of the formula

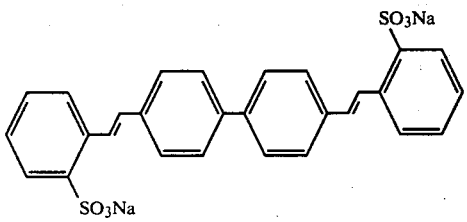

(13)

are introduced at 50° to 60° C. into a mixture of 60 g of ε-caprolactam and 25 g of water. The mixture is stirred for 1 hour at 70° to 75° C. and the fluorescent brightener goes into solution. The resulting solution is stable on storage and stable to cold and its miscibility with water is excellent.

EXAMPLE 5

10 g of the fluorescent brightener of the formula

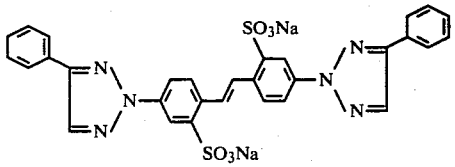

(14)

are introduced at 50° to 60° C. into a mixture of 45 g of ε-caprolactam and 45 g of water. The mixture is stirred for 15 minutes at 70° to 80° C. and the fluorescent brightener goes into solution. The resulting solution is stable on storage and stable to cold and its miscibility with water is excellent.

EXAMPLES 3a–5a 4 g of the solution according to Example 3, 6.6 g of the solution according to Example 4 or 10 g of the solution according to Example 5 are diluted with, in each case, 1,000 ml of water. A solution of 0.2 g of sodium sulfate in 100 ml of water is added to, in each case, 2 ml of each of these dilute solutions. A cotton fabric weighing 3 g is put into each of these fluorescent brightener solutions, which have been warmed to 40° to 45° C., and left in the solutions for 30 minutes. The fabric is then rinsed for 2 minutes in running cold water and then dried for 20 minutes at 60° C.

The fabric treated in this way has a powerful white effect with good fastness to light in all three cases.

EXAMPLES 3b–5b 4 g of the solution according to Example 3, 6.6 g of the solution according to Example 4 or 10 g of the solution according to Example 5 are diluted with water to a volume of 100 ml in each case. 20 ml of these solutions are diluted with 80 ml of water. Each of the solutions thus obtained is used to pad a pre-bleached cottom fabric at room temperature (liquor pick-up 60 to 70%). The fabric is then dried immediately at 130° C. for 30 seconds.

The fabric treated in this way has a powerful white effect with good fastness to light in all three cases.

EXAMPLES 4c AND 5c 6.6 g of the solution according to Example 4 or 10 g of the solution according to Example 5 are diluted with water to a volume of 1,000 ml in each case. 100 ml of water are added to 3 ml of these solutions. A polyamide fabric (polyamide 6 or 66) weighing 3 g is added to each of these fluorescent brightener solutions, which have been warmed to 60° C. The temperature is raised to 95° to 97° C. in the course of 10 to 15 minutes and this temperature is maintained for 30 minutes. The fabric is then rinsed for 2 minutes in running cold water and is then dried for 20 minutes at 60° C.

The fabric treated in this way has a powerful white effect with good fastness to light in both cases.

EXAMPLES 4d AND 5d

Polyamide fibre fabric is padded at room temperature with one of the baths of the following compositions: 2 g of the solution according to Example 4 or 3 g of the solution according to Example 5, 10 g of urea, 3 g of ®Albegal C, 12 ml of 80% acetic acid and 1,000 ml of softened water. The liquor pick-up is about 70%.

The fabric is then dried immediately at 130° C. for 30 seconds.

The fabric treated in this way has a powerful white effect with good fastness to light in both cases.

EXAMPLE 4e

A pigment coating liquor of the following composition is prepared: 150 ml of a 50% aqueous dispersion of a synthetic resin based on a crosslinkable methyl acrylate/styrene copolymer, 100 ml of water containing 2 g of sodium polyphosphate, 600 ml of water containing 25 g of the solution obtained according to Example 4, 50 ml of water containing 2 g of nonylphenol ether and 500 g of aluminium magnesium silicate.

A sized and weighted sulfite cellulose raw paper is coated with this treatment liquor and then dried. A paper with very high whiteness is thus obtained.

EXAMPLE 4f 50 g of bleached cellulose (10% suspension) are stirred in a metal beaker with 99 ml of water and 1 ml of 10% aluminium sulfate solution. After 2 minutes, 7.5 ml of a 10% filler suspension (kaolin) are added and after 10 minutes 0.06 g of the solution obtained according to Example 4 is added. At intervals of a further 2 minutes in each case, 2 ml of 5% resin size solution and 1.5 ml of 10% aluminium sulfate solution are added. The mixture is then made up to 500 ml with water and the suspension is transferred to a mixing beaker, made up to 1,000 ml with water and mixed for 2 seconds. Processing of the pulp to paper sheets, including pressing and drying, is carried out in a known manner.

The paper thus obtained has a powerful white effect with good fastness to light.

EXAMPLES 6–18

If, in each case, 20 g of one of the fluorescent brighteners of the general formula

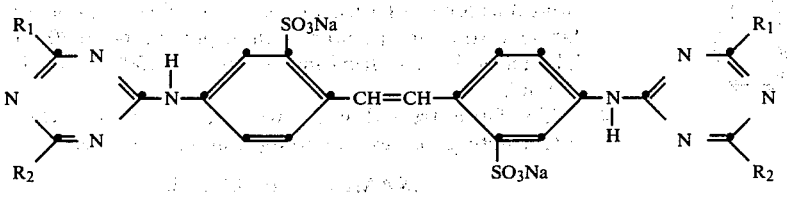

which are defined in the following table are introduced at 50° to 60° C. into a mixture of 18 g of polyethylene glycol 5000/6000, 12 g of ε-caprolactam and 50 g of water and the mixture is stirred for 30 minutes at 70° to 80° C., this yields, in each case, a fluorescent brightener formulation which is stable on storage and stable to cold and has excellent miscibility with water.

TABLE

| Example | $R_1$ | $R_2$ |
|---|---|---|
| 6 | 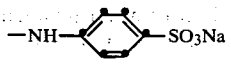 | $-N(CH_2CH_2OH)_2$ |
| 7 | 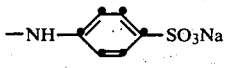 | $-N(CH_3)(CH_2CH_2OH)$ |
| 8 | 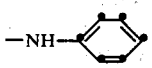 | $-N(CH_3)(CH_2CH_2OH)$ |
| 9 | 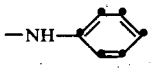 | $-NH(CH_2)_3-O-CH_3$ |
| 10 | 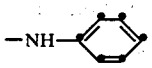 | 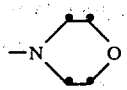 |
| 11 | $-SCH_3$ | 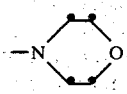 |
| 12 | 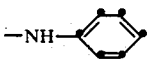 | $-OCH_3$ |

TABLE-continued

| Example | $R_1$ | $R_2$ |
|---|---|---|
| 13 | 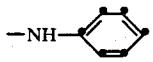 | 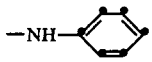 |
| 14 | 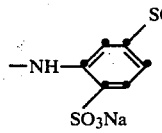 | $-N(C_2H_5)_2$ |
| 15 | $-N(CH_2CH_2OH)_2$ | $-OCH_3$ |
| 16 | 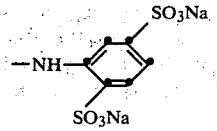 | 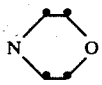 |
| 17 | $-NHCH_2CH_2OCH_2CH_2OH$ | $-OCH_3$ |
| 18 | $-N(CH_2-\overset{OH}{\overset{\vert}{C}H}-CH_3)_2$ | $-N(CH_2-\overset{OH}{\overset{\vert}{C}H}-CH_3)_2$ |

What is claimed is:

1. A concentrated aqueous solution, which is stable on storage, of a sulfo group-containing fluorescent brightener, which contains a stilbene fluorescent brightener substituted by sulfo groups and a lactam of the formula

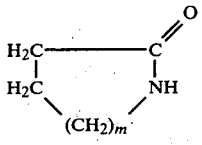

in which m is 0 or an integer between 1 and 9.

2. A solution according to claim 1, which additionally contains one or more water-miscible organic solvents.

3. A solution according to claim 2, which contains, as water-miscible solvents, propanol, isopropanol, ethylene glycol, propylene glycol, glycerol, di- or triethylene glycol, dipropylene glycol, ethylene glycol monomethyl ether or ethylene glycol monoethyl ether, diethylene glycol monoethyl ether, formamide, dimethylformamide, dimethylacetamide, ethanolamine, diethanolamine, triethanolamine, N-methylpyrrolidone, polyethylene glycols or polyvinylpyrrolidone.

4. A solution according to claim 1 or 2, wherein the sulfo group-containing fluorescent brightener is a fluorescent brightener of this type of the category of the bis-triazinylaminostilbene-, bis-triazolylstilbene- or bis-stilbene-disulfonic acids and their salts.

5. A solution according to claim 4, wherein the sulfo group-containing fluorescent brightener is a fluorescent brightener of this type of the formula

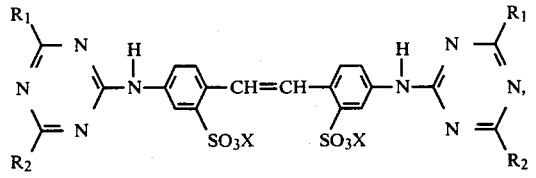

in which X is hydrogen or an alkali metal, ammonium or amine ion and $R_1$ and $R_2$ independently of one another are each $NH_2$, $NH-CH_3$, $NH-C_2H_5$, $N(CH_3)_2$, $N(C_2H_5)_2$,
$NH-CH_2-CH_2-OH$, $NH-CH_2-CH_2-CH_2-OH$,
$N(CH_2-CH_2-OH)_2$, $N(CH_2-CH_2-CH_2-OH)_2$,
$N(CH_3)(CH_2-CH_2-OH)$,
$NH-CH_2-CH_2-O-CH_2-CH_2-OH$,
$NH-CH_2-CH_2-SO_3X$, OH, $OCH_3$, $OCH(CH_3)_2$,

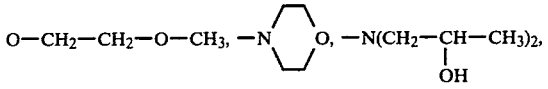

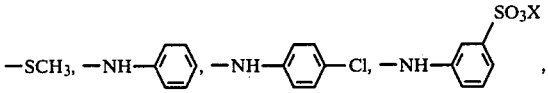

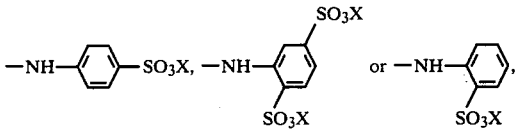

of the formula

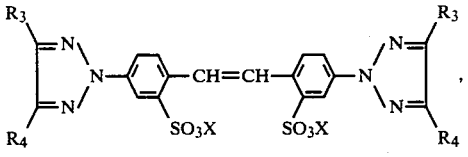

in which X is hydrogen or an alkali metal, ammonium or amine ion and $R_3$ and $R_4$ independently of one another are hydrogen,

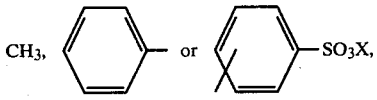

or $R_3$ and $R_4$ together form the remaining part of a benzene ring, or of the formula

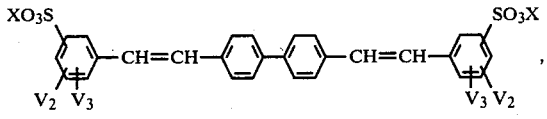

in which $V_2$ is hydrogen, alkyl having 1 to 4 carbon atoms, alkoxy having 1 to 4 carbon atoms, halogen or the sulfo group, or an alkali metal, ammonium or amine salt thereof, $V_3$ is hydrogen or alkyl having 1 to 4 carbon atoms and X is hydrogen or an alkali metal, ammonium or amine ion.

6. A solution according to claim 5, wherein the fluorescent brightener is a fluorescent brightener of the formula

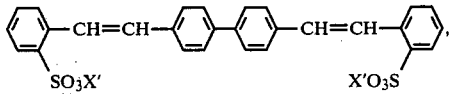

in which X' is hydrogen or sodium.

7. A solution according to claim 1, which contains 10 to 30 percent by weight of fluorescent brightener, 10 to 80 percent by weight of lactam and 10 to 80 percent by weight of water.

8. A solution according to claim 2, which contains 10 to 30 percent by weight of fluorescent brightener, 10 to 80 percent by weight of lactam, 5 to 75 percent by weight of organic solvent and 5 to 75 percent by weight of water.

9. A solution according to claim 1 or 2, which contains ϵ-caprolactam as the lactam.

* * * * *